United States Patent [19]

Frost

[11] 3,945,141

[45] Mar. 23, 1976

[54] TRANSPARENT CARRIER SHEET CARRYING TRANSFERABLE INDICIA AND REFERENCE TRANSFERABLE GUIDE MARKS AND METHOD OF UTILIZING THE SAME FOR SIGN-MAKING

[76] Inventor: William B. Frost, 1717 - 99th NE., Bellevue, Wash. 98004

[22] Filed: Oct. 29, 1974

[21] Appl. No.: 518,403

[52] U.S. Cl. ..... 40/125 A; 101/34; 156/234; 428/195

[51] Int. Cl.[2] ..... B44C 1/00

[58] Field of Search ..... 156/71, 230, 234, 277; 161/406, 409; 282/23 R; 40/125 A; 101/34; 428/195

[56] References Cited

UNITED STATES PATENTS

| | | | |
|---|---|---|---|
| 2,970,043 | 1/1961 | Serafin | 161/413 |
| 3,013,917 | 12/1961 | Karlan et al. | 161/409 |
| 3,137,605 | 6/1964 | Buetow | 156/230 |
| 3,676,248 | 7/1972 | Swartz | 156/230 |

*Primary Examiner*—Edward G. Whitby
*Attorney, Agent, or Firm*—Robert W. Beach

[57] ABSTRACT

A specifically sized transferable indicia sheet has reference marks, which are also transferable guide marks, underlaid on a substantially transparent carrier sheet and arranged in a plurality of horizontal rows. Such guide marks are transferable to a correspondingly sized receiving surface by aligning left, right and top edges of the carrier sheet with corresponding edges of the receiving surface and rubbing the exposed surface of the carrier sheet over the guide marks. The area of the carrier sheet from which the guide marks have been removed is clear in contrast to the surrounding carrier sheet portions which have a frosted appearance. The clear areas of the indicia sheet formed by transfer of the guide marks to the receiving surface constitute reference marks. Opaque indicia, including letters, carried by the carrier sheet in rows bear a predetermined relationship to the reference and transferable guide marks on the carrier sheet along horizontal rows and can be transferred to the receiving surface by rubbing the exposed surface of the carrier sheet over selected indicia when a reference line on the carrier sheet is held in registration with a guide line transferred to the receiving surface, so as to place indicia on the receiving surface in a desired relationship to the horizontal lines and vertical margin marks transferred to the receiving surface.

20 Claims, 3 Drawing Figures

TRANSPARENT CARRIER SHEET CARRYING TRANSFERABLE INDICIA AND REFERENCE TRANSFERABLE GUIDE MARKS AND METHOD OF UTILIZING THE SAME FOR SIGN-MAKING

The present invention relates to transparent carrier sheets carrying guide marks and indicia transferable to a receiving surface.

A principal object of the invention is to provide transferable guide marks, as well as transferable indicia, on a transparent carrier sheet to facilitate placement of indicia in desired locations on a receiving surface without the necessity of having guide lines on the receiving surface.

A further object is to provide reference marks on a carrier sheet which can be used for locating indicia to be transferred with reference to the receiving surface without requiring appreciable skill for such use.

Another object is to provide reference marks which will enable indicia to be transferred to the receiving surface in desired locations very quickly.

It is also an object to provide marks on a carrier sheet which can both supply guide marks that can be transferred to a receiving surface and leave reference marks on the carrier sheet after transfer.

Figure 2:
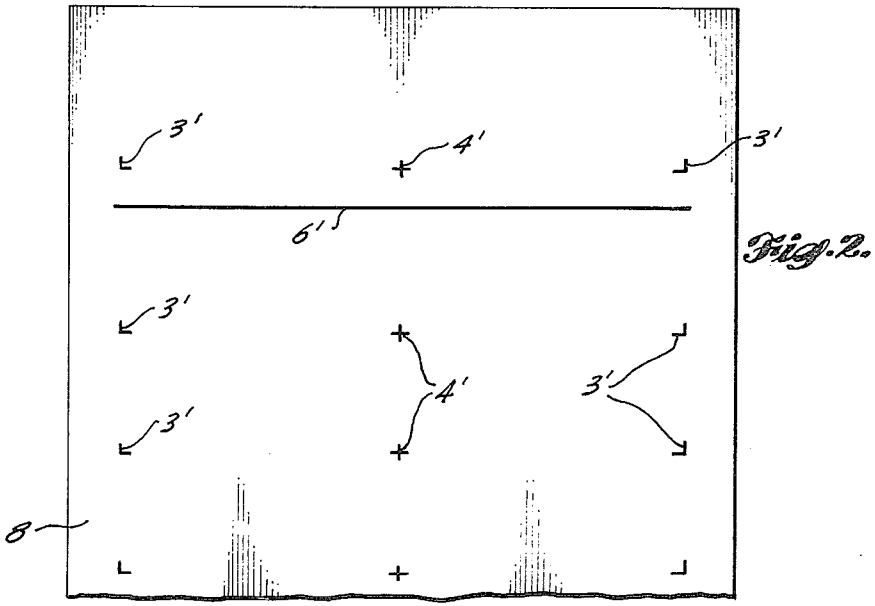
FIG. 2 is an elevation of the receiving surface to which guide marks have been transferred preparatory to transfer of indicia to the receiving surface.

Transparent carrier sheets carrying underlaid indicia transferable to a receiving surface by rubbing the exposed surface of the carrier sheet over the indicia to be transferred are commercially available. Representative types are disclosed in U.S. Pat. Nos. 2,970,043 and 3,013,917, for example. These sheets are printed with underlaid indicia, such as letters and numerals, and such indicia are very precise and uniform in shape. They can be transferred readily from the carrier sheet to a receiving surface simply by holding the carrier sheet against the receiving surface and rubbing the exposed side of the carrier sheet over the indicia to be transferred. The difficulty with utilizing indicia transferred from such carrier sheets in the past has been the trouble of laying out on the receiving surface the pattern of indicia to be transferred to it from the carrier sheet.

The user of carrier sheets bearing transferable indicia normally has been required to draw guide lines on the receiving surface for alignment of indicia and, if the indicia is to be placed in more than one line, it has been necessary to draw a plurality of spaced lines. Moreover, if the receiving surface is vertical, such lines must be drawn horizontally true. If it is desired to locate the indicia in a particular relationship transversely of the receiving surface, it may also be necessary to draw on the receiving surface an appropriate vertical line or lines. In either case, it is difficult to hold measuring and straightedge devices to assure accurate marking. Additionally, since some portion of the indicia normally abuts the horizontal guide lines, it is difficult to remove completely such lines promptly after transfer of the indicia without damaging the transferred indicia.

The use of indicia in the form of letters and numbers transferred from a transparent carrier sheet is particularly convenient for use in signs of various types, such as names and numbers on nameplates or directory boards. Frequently such signs require more than one line of letters and/or numbers. In a particular building or in a particular company uniformity of placement and style of indicia is usually desired for signs and nameplates, even though different signs may be made at different times, such as several years apart, and by different people. By use of the present invention the indicia will always be of the same style from time to time, and the different rows of indicia will always be spaced apart the same distance.

The transparent carrier sheet 1 is illustrated in the drawings as having underlaid transferable indicia in the form of upper case and lower case letters 2. The indicia could, alternatively or in addition, include numerals. Moreover, a greater number of each of the more commonly occurring letters will be provided than of the less commonly occurring letters. In addition to the indicia, the carrier sheet will have underlaid marks which are both reference marks and guide transferable to a receiving surface. Such combined reference and transferable guide marks are illustrated in the form of angles 3, crosses 4 and dashes 5.

Each of the three types of guide marks illustrated is arranged on the carrier sheet along a plurality of horizontal lines A through H. The angle guide marks and the cross guide marks each include a section of a horizontal reference line and a section of a vertical reference line. The horizontal line sections of the guide marks in each horizontal line are aligned horizontally, and the vertical line sections of the guide marks in the respective horizontal lines are aligned vertically from line to line. At least the angles and crosses are printed on the underside of the carrier sheet 1 so that they can be transferred in the same manner as the transferrable indicia, such as the letters 2.

Before transfer of any indicia or guide marks, the carrier sheet includes opaque indicia and guide marks and a transparent but less than clear, such as frosted, background portion entirely surrounding the indicia and guide marks. After transfer of any guide mark or indicia, the location from which such transferred mark or indicia was transferred is clear so that it has a different degree of transparency than the background portion and, therefore, contrasts with the surrounding transparent background area. Consequently, even after guide marks are transferred to the receiving surface, their outlines are clearly visible on the carrier sheet for continued use as clear residual reference marks to be registered with the opaque guide marks transferred to the receiving surface. Therefore, the reference marks in lines A through H, whether clear following transfer of the guide marks to a receiving surface or opaque before such transfer, can be registered with guide marks transferred to the receiving surface to position selected indicia 2 in the adjacent rows for transfer to the receiving surface, as described below.

The reference and transferable guide marks bear a predetermined relationship to the indicia on the carrier sheet. A line of reference and transferable guide marks is provided for each row of indicia elements, and the relationship between each row of indicia elements and the line of reference and transferable guide marks immediately beneath it is the same as the relationship between each other row of indicia units on the carrier sheet and the line of reference and transferable guide marks immediately beneath it. For example, the reference and transferable guide marks in line A are spaced the same distance below the lowest portions of the capital letters above line A as the reference and transferable guide marks in line D are spaced from the lowest portions of the row of capital letters above line D. The same spacing is used between the reference and transferable guide marks of line E and an imaginary line along the bottom of lower case *a* extending to the lower horizontal tangent of the circle of lower case *g*.

Moreover, each line of reference and transferable guide marks is spaced from the row of indicia immediately above it such that the line of reference and transferable guide marks is lower than the portion of the indicia in the row projecting downward or descending farthest from such row, so that the temporary guide marks transferred from the carrier sheet to the receiving surface can be removed after completion of the indicia transferring operation without damage to the permanent indicia transferred to such surface. In the drawings, the line E of reference and transferable guide marks below the fifth row of indicia from the top, for example is lower than the downwardly projecting tail of the descending letter *g*. Similarly, the line G of guide and reference marks immediately below the seventh row of indicia from the top of sheet 1 is lower than the lower ends of the tails on the descending letters *p* and *q*. Correspondingly, the line H of reference and transferable guide marks below the eighth indicia row from the top is lower than the downwardly projecting tail of the *y*.

The horizontal leg of each angle reference and transferable guide mark 3 and the horizontal line of each cross 4 are in a horizontal line. In addition, the dashes 5 are aligned with the horizontal legs of the angles 3 and the horizontal lines of the crosses 4. The dashes 5 are located between adjacent crosses and angles. Where crosses and/or angles are located in various horizontal lines, such as the lines A to H, inclusive, shown in FIG. 1, the vertical line sections of the angles in the various lines will be aligned vertically, and the vertical line sections in the various crosses will be aligned vertically. Consequently, in any column of angles 3 or crosses 4 the aligned vertical line sections will define vertical lines intersecting the horizontal lines A to H, inclusive.

Figure 1:
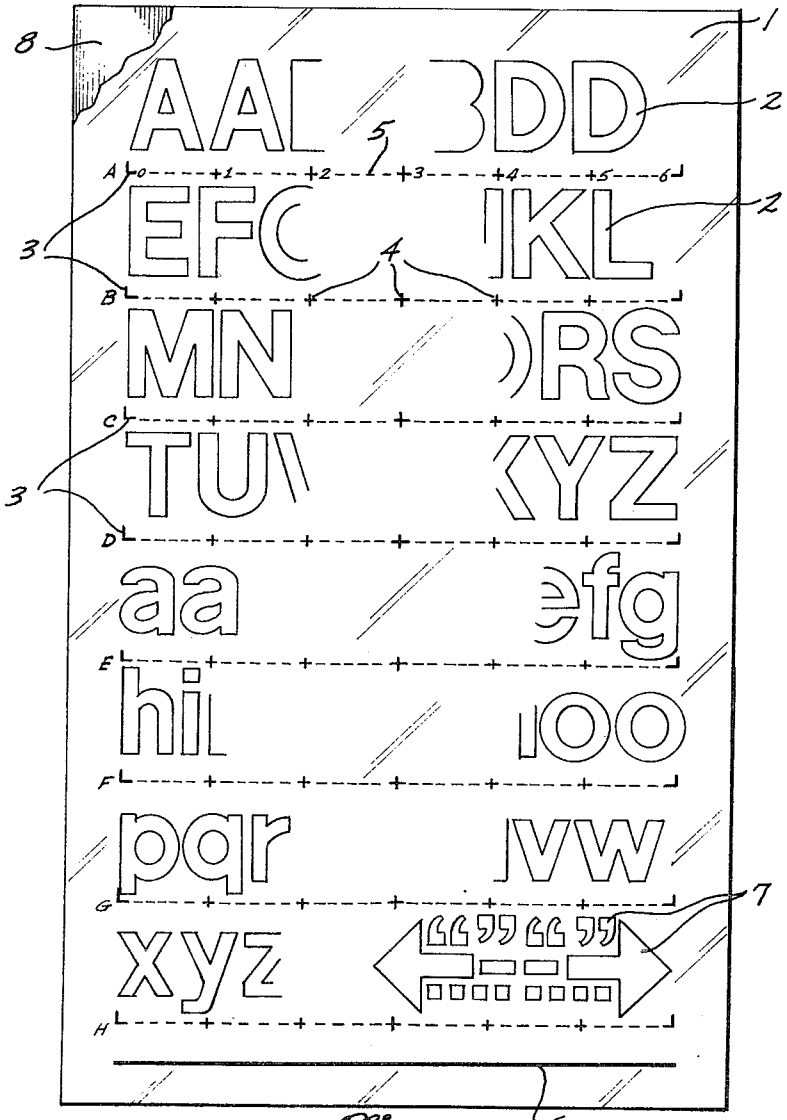
FIG. 1 is an elevation of a transparent carrier sheet according to the present invention, having parts broken away, in position squarely overlying an upright receiving surface of equal width.

The crosses may be spaced apart equal distances along a line, such as, for example, at one inch intervals, which intervals may be numbered as indicated in line A of FIG. 1 by the numbers 0 through 6. Thus, the reference line can be used as a ruler for measuring line lengths. Equal spacing between adjacent angles and crosses permits transferring of a line onto the receiving surface longer than the six-inch reference line on the carrier sheet by first transferring the left angle and the five crosses of line A to form a five inch line. If the receiving surface line is to be ten inches, for example, the left angle of line B could be registered with the fourth cross of line A transferred to the receiving surface and the first cross of line B registered with the fifth cross previously transferred from line A. The second through fifth crosses and the right-hand angle of row B would then be transferred to the receiving surface to form the balance of the 10 inch line. If the line is to be four inches, the left angle and four crosses would be transferred. Alternatively, if it is preferred that the line end be definitely marked with an angle, the left angle and three crosses would be transferred and the carrier sheet moved to the left so that the fourth and fifth crosses register respectively with the second and third transferred crosses. The right-hand angle is then in position to be transferred to complete the four inch line.

At least the angles 3 and crosses 4 underlaid on the carrier sheet 1 must be transferable to the receiving surface by rubbing the exposed surface of the carrier sheet over such guide marks, and preferably the dashes 5 also are transferable. After transference at least of the angles 3 and crosses 4, and preferably also after transference of dashes 5, a residual visual reference impression of the guide marks transferred will remain on the carrier sheet in the form of clear portions contrasting with the less transparent carrier sheet background portions. In addition to the letters 2, the carrier sheet 1 can carry other types of indicia, such as a line 6 and the arrows and punctuation marks 7.

A principal use for the transparent carrier sheet of the present invention is for lettering signs. Such signs may customarily include a room number, the name of an individual and his title, such as E. A. SMITH, PRESIDENT. The room number may be on one line, the name may be on another line and the title can be placed in the next lower line. The word PRESIDENT is slightly longer than the designation E. A. SMITH. It may be desired to place the words E. A. SMITH and PRESIDENT with their left letters in vertical alignment, or with their right letters in vertical alignment, or it may be preferred to center both designations on a receiving surface. Such vertical alignment is readily determined by selecting the appropriate vertically aligned reference and transferable guide marks 3 and 4 as the starting location for each line of lettering.

Figure 3:
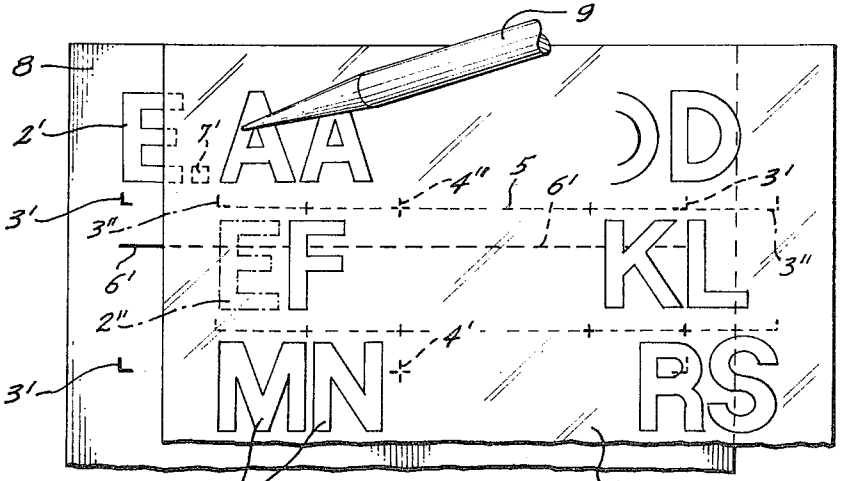
FIG. 3 is an elevation of a fragmentary portion of an upright receiving surface and a fragmentary portion of a carrier sheet shown in a representative overlapping relationship which the carrier sheet would occupy during an indicia transferring operation.

The receiving surface 8 preferably is a panel of the same size or at least of the same width, as the carrier sheet 1, as shown in FIGS. 1 and 3. Such panel can be affixed to a door wall or other object. For purposes of illustration, it is assumed that the receiving surface 8 is the surface of a panel of a size adopted as a standard for securement to doors or walls of a particular building. For convenience in such applications carrier sheets 1 could be provided of the same width as the width of the receiving surface 8 as stated above and the reference lines can be imprinted to conform to such a standardized application.

Only two points from one to six inches apart are sufficient to define a horizontal line on the receiving surface corresponding to the desired location of a row of indicia to be transferred to the receiving surface. An angle and a cross, or two crosses, may be transferred from the carrier sheet to mark such two points, and all other guide marks necessary for the particular application would be laid out on and transferred to the receiving surface by use of the guide marks 3 and 4 on the carrier sheet.

Where the carrier sheet 1 and receiving surface 8 are of the same width as shown in the drawings and it is desired to provide two or more rows of indicia on such receiving surface, the guide marks can be transferred from the carrier sheet to the receiving surface according to the pattern shown in FIG. 2. In this illustration, the top line of indicia is to be separated from the remaining indicia by a dividing line. Assuming that there are to be four rows of indicia, four lines of guide marks will be transferred from the carrier sheet 1 to the receiving surface 8, as illustrated in FIG. 2. Guide marks and indicia transferred to the receiving surface 8 are indicated by primed numerals. The residual clear images on the carrier sheet, constituting reference marks are indicated by double-primed numerals, and where possible are shown as dot-dash lines.

The operation of transferring the guide marks from the transparent carrier sheet 1 to the reference surface 8 can be accomplished by first placing the transparent carrier sheet in overlying registration with the receiving surface 8 by aligning the upper edge of the carrier sheet with the upper end of the receiving surface 8 and with opposite edges of the carrier sheet flush with the opposite edges of the receiving surface. The exposed surface of the carrier sheet is then rubbed over the guide marks which it is desired to transfer, such as with a stylus 9.

The procedure for providing the guide mark pattern on the receiving surface 8, as shown in FIG. 2, is first to rub the exposed surface of carrier sheet 1 over the angle guide marks 3 and over the central cross guide mark 4 of line A shown in FIG. 1. Such transferring operation will result in the placement on the receiving surface 8 of the first transferred reference line of angle guide marks 3' and the cross guide mark 4', as shown near the top of FIG. 2.

As stated above, in the particular instance of FIG. 2, it is desired to have the upper row of indicia on the finished sign separated from the three lower rows by a dividing line 6. Consequently, after the guide marks in the highest line of FIG. 2 have been placed, the transparent carrier sheet 1 will be slid upward along the receiving surface until the angles at the opposite ends of the reference mark line H and the central cross are in precise registration with the angles 3' and the cross 4' of the first reference line transferred to the receiving surface 8. The exposed side of the carrier sheet 1 over the line 6 will then be rubbed to transfer such line onto the receiving surface 8, as indicated at 6'.

Additional horizontal lines of guide marks can then be transferred to the receiving surface 8 below the dividing line 6' by again moving the transparent carrier sheet down until the line A of residual reference marks is precisely in registration with the underline 6'. The exposed surface of the carrier sheet 1 over the angles 3 and central cross 4 of guide mark lines B, C and D will then be rubbed to transfer such guide marks onto the receiving surface at the locations indicated in FIG. 2 below the underline 6'. The receiving surface is then prepared for transferring onto it other indicia from the carrier sheet 1.

A further operation of transferring indicia from the carrier sheet 1 to the receiving surface 8 is illustrated in FIG. 3. Horizontal portions of the reference B were first placed in registration with horizontal portions of the top transferred guide line, above the underline 6', on the receiving surface 8. The left side of the letter to be transferred to the receiving surface, which is the capital letter E in this instance, was then aligned vertically with the vertical portion of the left guide angle 3'. The exposed surface of the carrier sheet 1 was then rubbed over the E to transfer that letter, designated 2' in FIG. 3, onto the receiving surface and leaving a residual clear image 2'' on the carrier sheet 1. Next, dashes 5 of the reference mark line H were placed in registration with the horizontal leg of the upper angle 3' at the left of FIG. 3 and with the horizontal line section of the upper cross 4'. The period was placed close to the letter E and the exposed surface of the carrier sheet 1 over that period was then rubbed to transfer to the receiving surface 8 the period designated 7' in FIG. 3.

Next the carrier sheet 1 in FIG. 3 has been shifted so that the reference dashes 5 beneath the top indicia row have been placed in registration with the horizontal guide line segment of the cross 4' and the horizontal guide line segment of the righthand angle guide mark 3' in position to locate an A in the top indicia row close to the period 7'. Next the exposed surface of the carrier sheet over the letter A is rubbed to transfer such letter from the carrier sheet to the receiving surface 8.

Because the reference mark line A bears a predetermined relationship to the top row of indicia on carrier sheet 1 and that relationship is the same as the relationship between the reference mark line B and the row of indicia next above it, locating the reference mark line B in registration with the upper guide marks 3' and 4' while the indicia E is being transferred to the receiving surface 8 and locating the reference mark line A in registration with the same guide marks 3' and 4' while the letter A is being transferred from the carrier sheet to the receiving surface will insure that the transferred E and the transferred A are precisely aligned in the same horizontal row.

The transfer operations described above will be followed to transfer another period from the bottom indicia row of the carrier sheet, an S from the indicia row above reference mark line C, an M from the same indicia row, an I from the indicia row next above reference mark line B, a T from the indicia row next above the reference mark line D and, finally, H from the indicia row next above reference mark line B. During all of these transfers the respective mark line under the individual letters will be placed in registration with the horizontal guide on the receiving surface 8 defined by the top horizontal line segments 3' and 4' transferred to the receiving surface.

One or more successively lower indicia lines can subsequently be formed by transferring desired indicia element by element from the carrier sheet to the receiving surface in the manner explained above while, in every instance, the reference mark line below each character being transferred is in precise registration with the appropriate guide mark line that has been transferred to the receiving surface 8. The reference line marks may be residual clear marks 3'', 4'' or formed by opaque marks 3, 4, depending on whether the particular reference and transferable guide mark line had been used to transfer guide marks 3', 4' to the receiving surface 8.

In placing on the receiving surface the successive rows of indicia, each indicia row may be started with the left side of the first indicia element substantially aligned with the vertical line section portion of the angle guide mark at the left end of the indicia row reference line to produce an aligned left margin in the final indicia display. If it is desired to align the right margin instead, the last letter of each line will be transferred first and its right edge will be vertically aligned with the vertical line section portion of the angle guide mark at the right end of the guide line. In this instance, the indicia elements would be transferred sequentially from right to left. Alternatively, the indicia in each row can be centered by placing the central letter or space of the respective indicia rows in centered vertical alignment with the vertical line sections of the center crosses 4'. The appropriate letters can then be placed in sequence at each side of the centered letter or space to complete the row of indicia desired. The more important factor is that in each instance the elevational positions of all of the indicia rows on the receiving surface will be established precisely by utilization of the guide marks transferred to the receiving surface 8 in the manner described above. The spacing of the indicia rows on the receiving surface, except for underlined rows, will therefore be precisely the same as the spacing of indicia rows on the carrier sheet.

After the transfer of letters from the carrier sheet 1 onto the receiving surface 8 has been completed in the manner described above for each row guide, the marks 3' and 4' can easily be removed from the receiving surface by applying pressure-sensitive tape to the receiving surface over each of them and then removing the pressure-sensitive tape. This operation strips the transferred guide marks from the receiving surface. Similarly, if an error has been made in selecting any letter, that letter can be removed by applying pressure-sensitive tape to the receiving surface over the letter and then removing the tape to strip such letter from the receiving surface. In fact, this same technique can be used for removing one or more transferred letters from a receiving surface at any time and replacing such letter or letters with a substitute transferred letter or letters to revise the sign. By this procedure the name of a particular officer can be changed, for example, or the title associated with a particular name of a person can be changed.

Representative types of guide marks transferable from a carrier sheet to the receiving surface have been described, but other types of guide marks can be used for effecting desired placement of indicia transferred from a carrier sheet to a receiving surface. Several rows of crosses 4 are shown in FIG. 1, the vertical line sections of which are aligned in columns which can be utilized to provide different marginal indentations or to place in alignment different indicia to be aligned in columns. It is not necessary ordinarily to provide guide marks on a receiving surface to establish horizontal spacing of letters; if the letters are placed sufficiently close, approximately equal clearance, such as hairline spacing between adjacent letters can be provided simply by eyesight judgment.

I claim:

1. In a transparent carrier sheet carrying a plurality of rows of underlaid indicia transferable to a receiving surface by rubbing the exposed surface of the carrier sheet over the indicia to be transferred, the improvement comprising such indicia including at least one descending lower case letter, and reference marks and underlaid transferable guide marks carried by the carrier sheet, said guide marks being transferable to a receiving surface by rubbing the exposed surface of the carrier sheet over said guide marks, said reference marks and transferable guide marks being arranged on the carrier sheet along a plurality of horizontal lines, each line including both reference marks and transferable guide marks, each line being located the same distance below the row of indicia next above it as another line is located below the row of indicia next above such other line, and the line next below the row of indicia containing a descending lower case letter being below the downwardly projecting portion of such descending lower case letter.

2. In the carrier sheet defined in claim 1, transferable guide marks in a plurality of horizontal lines also being arranged in at least one vertical line.

3. In the carrier sheet defined in claim 2, transferable guide marks in a plurality of horizontal lines also being arranged along a plurality of vertical lines.

4. In the carrier sheet defined in claim 1, at least one of the transferable guide marks including a vertical line section and a horizontal line section.

5. In the carrier sheet defined in claim 1, at least one of the transferable guide marks being a cross.

6. In the carrier sheet defined in claim 1, at least one of the transferable guide marks being an angle.

7. In the carrier sheet defined in claim 1, each horizontal line being located higher than all portions of the indicia in the indicia row next below such line.

8. In the carrier sheet defined in claim 1, the transferable guide marks being opaque, and transparent reference marks in precise registration with said opaque guide marks.

9. In the carrier sheet defined in claim 8, the carrier sheet background and the transparent reference marks being transparent in a different degree.

10. The method of placing indicia on a receiving surface from a transparent carrier sheet carrying transferable underlaid indicia and transferable underlaid guide marks, which comprises placing the carrier sheet in overlying relationship to the receiving surface, locating guide marks on the carrier sheet in desired locations with reference to the receiving surface, rubbing the exposed surface of the carrier sheet over such guide marks for transferring such guide marks to the receiving surface, shifting the carrier sheet to place in registration with the transferred guide marks reference marks on the carrier sheet related to selected indicia desired to be transferred to the receiving surface, and, while such reference marks are held in registration with the guide marks transferred to the receiving surface, rubbing the exposed surface of the carrier sheet over such selected indicia to transfer such selected indicia to the receiving surface.

11. The method defined in claim 10, including transferring to the receiving surface guide marks in a plurality of horizontal lines.

12. The method defined in claim 10, in which reference marks and transferable guide marks on the carrier sheet are in the same line.

13. The method defined in claim 10, in which the step of transferring guide marks from the carrier sheet to the receiving surface leaves transparent reference marks on the carrier sheet at locations occupied by guide marks before they were transferred to the receiving surface.

14. The method defined in claim 10, in which the receiving surface is the surface of a panel of the same width as the transparent carrier sheet, and the step of placing the carrier sheet in overlying relationship to the receiving surface includes placing the opposite vertical edges of the carrier sheet in registration with the opposite vertical edges of the panel.

15. The method defined in claim 10, in which the receiving surface is the surface of a panel of the same width as the transparent carrier sheet, and the step of placing the carrier sheet in overlying relationship to the receiving surface includes placing the opposite vertical edges of the carrier sheet in registration with the opposite vertical edges of the panel and placing the upper edge of the carrier sheet in registration with the upper edge of the panel.

16. In a receiving surface for receiving a plurality of rows of indicia transferred from a transparent carrier sheet by rubbing the exposed surface of the carrier sheet over the indicia to be transferred, the improvement comprising the receiving surface bearing guide marks transferred from the carrier sheet by rubbing the exposed surface of the carrier sheet over said guide marks, said guide marks being arranged on the receiving surface along a horizontal line.

17. In the receiving surface defined in claim 16, the guide marks being arranged on the receiving surface along a plurality of parallel horizontal lines.

18. In the receiving surface defined in claim 17, additional guide marks associated with the plurality of horizontal lines and arranged along a vertical line.

19. The combination comprising a panel having a receiving surface, and a transparent carrier sheet carrying a plurality of rows of underlaid indicia transferable to said receiving surface by rubbing the exposed surface of said carrier sheet over the indicia to be transferred and further carrying reference marks arranged along a plurality of horizontal lines, each line being located the same distance below the row of indicia next above it as another line is located below the row of indicia next above such other line, said receiving surface having thereon a plurality of horizontal lines of guide marks transferred from said carrier sheet by the exposed surface of the carrier sheet having been rubbed over guide marks underlaid on said carrier sheet, and said lines of guide marks on said receiving surface being spaced apart vertically the same distance as the vertical spacing of the lines of reference marks carried by said carrier sheet.

20. The combination defined in claim 19, in which the carrier sheet is of the same width as the panel and a line of guide marks on the receiving surface is positioned for disposition in registration with a line of reference marks on the carrier sheet when the carrier sheet is positioned on the panel with the opposite edges of the carrier sheet in registration with the opposite edges of the panel and with the top edge of the carrier sheet in registration with the top edge of the panel.

* * * * *

PO-1050
(5/69)

UNITED STATES PATENT OFFICE
CERTIFICATE OF CORRECTION

Patent No. 3,945,141 Dated March 23, 1976

Inventor(s) William B. Frost

It is certified that error appears in the above-identified patent and that said Letters Patent are hereby corrected as shown below:

Column 8, line 48, after "same" insert --horizontal--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*